US007765627B2

(12) United States Patent
Pan

(10) Patent No.: US 7,765,627 B2
(45) Date of Patent: Aug. 3, 2010

(54) SANITARY WARE WITH AN ANNULAR MOUNT

(75) Inventor: Chia-Chen Pan, Changhua Hsien (TW)

(73) Assignee: Sheng Tai Brassware Co., Ltd. (TW)

( * ) Notice: Subject to any disclaimer, the term of this patent is extended or adjusted under 35 U.S.C. 154(b) by 355 days.

(21) Appl. No.: 12/099,040

(22) Filed: Apr. 7, 2008

(65) Prior Publication Data

US 2009/0249540 A1 Oct. 8, 2009

(51) Int. Cl.
*A47K 3/00* (2006.01)

(52) U.S. Cl. ..... 4/615

(58) Field of Classification Search ..... 4/615–618, 4/567–570, 601, 605, 559, 448; 239/600, 239/289; 137/801; D23/223
See application file for complete search history.

(56) References Cited

U.S. PATENT DOCUMENTS

| | | | | |
|---|---|---|---|---|
| D357,972 | S * | 5/1995 | Huen | D23/223 |
| 7,237,277 | B1 * | 7/2007 | Tsai | 4/615 |
| D575,845 | S * | 8/2008 | Lobermeier et al. | D23/223 |
| D582,005 | S * | 12/2008 | Eshet et al. | D23/223 |
| D604,392 | S * | 11/2009 | Schoenherr et al. | D23/223 |
| 2008/0185456 | A1 * | 8/2008 | McCabe | 239/197 |

* cited by examiner

*Primary Examiner*—Gregory L Huson
*Assistant Examiner*—Janie Christiansen
(74) *Attorney, Agent, or Firm*—Hershkovitz & Associates, LLC; Abraham Hershkovitz

(57) ABSTRACT

A sanitary ware with an annular mount has a body, an inlet pipe and an annular mount. The inlet pipe is mounted inside the body. The annular mount is mounted through the body for hanging the sanitary ware. A structure of the annular mount is simple to prevent leaking and could be used in any sanitary ware. Therefore, the sanitary ware with annular mount can be hung anywhere by the annular mount.

5 Claims, 4 Drawing Sheets

SANITARY WARE WITH AN ANNULAR MOUNT

BACKGROUND OF THE INVENTION

1. Field of Invention

The present invention relates to a sanitary ware, and more particularly to a sanitary ware with an annular mount.

2. Description of the Related Art

Sanitary wares are commonly used in restrooms and bathrooms, may be but are not limited to shower heads, nozzles or hoses and each has a body. A sanitary ware is fixed to or removably mounted on a wall or ceiling. However, the sanitary ware is generally mounted in a clamp corresponding to the body so when replaced, corresponding clamps also require replacement complicating do-it-yourself replacement.

Thus, a need exists for a sanitary ware with an annular mount for providing a convenient way for use.

SUMMARY OF THE INVENTION

The primary objective of the present invention is to provide sanitary ware with an annular mount.

Sanitary ware with an annular mount has a body, an inlet pipe and an annular mount. The inlet pipe is mounted inside the body. The annular mount is mounted through the body for hanging the sanitary ware. A structure of the annular mount is simple to prevent leaking and could be used in any sanitary ware. Therefore, the sanitary ware with the annular mount can be hung anywhere by the annular mount.

Other objectives, advantages and novel features of the invention will become more apparent from the following detailed description when taken in conjunction with the accompanying drawings.

DETAILED DESCRIPTION OF THE INVENTION

As defined herein sanitary ware refers to shower heads, hoses, faucets, nozzles and the like.

Figure 1:
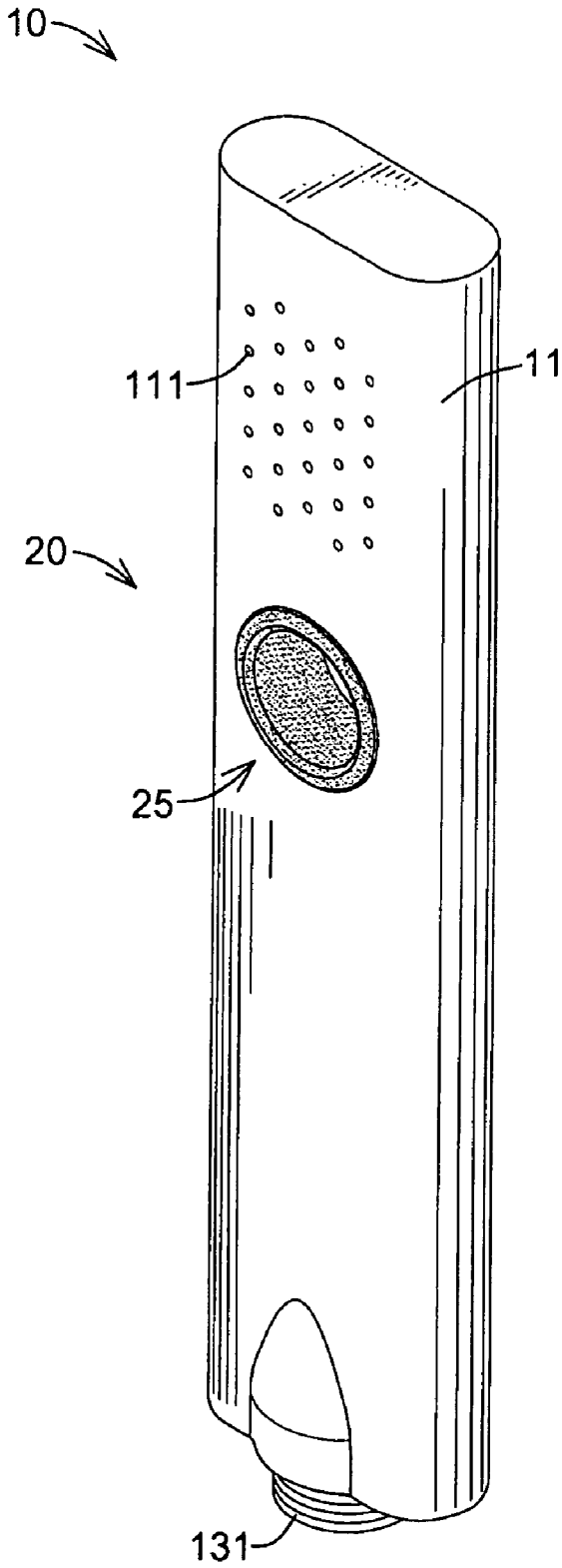
FIG. 1 is a perspective view of a sanitary ware with an annular mount in accordance with the present invention.
Figure 2:
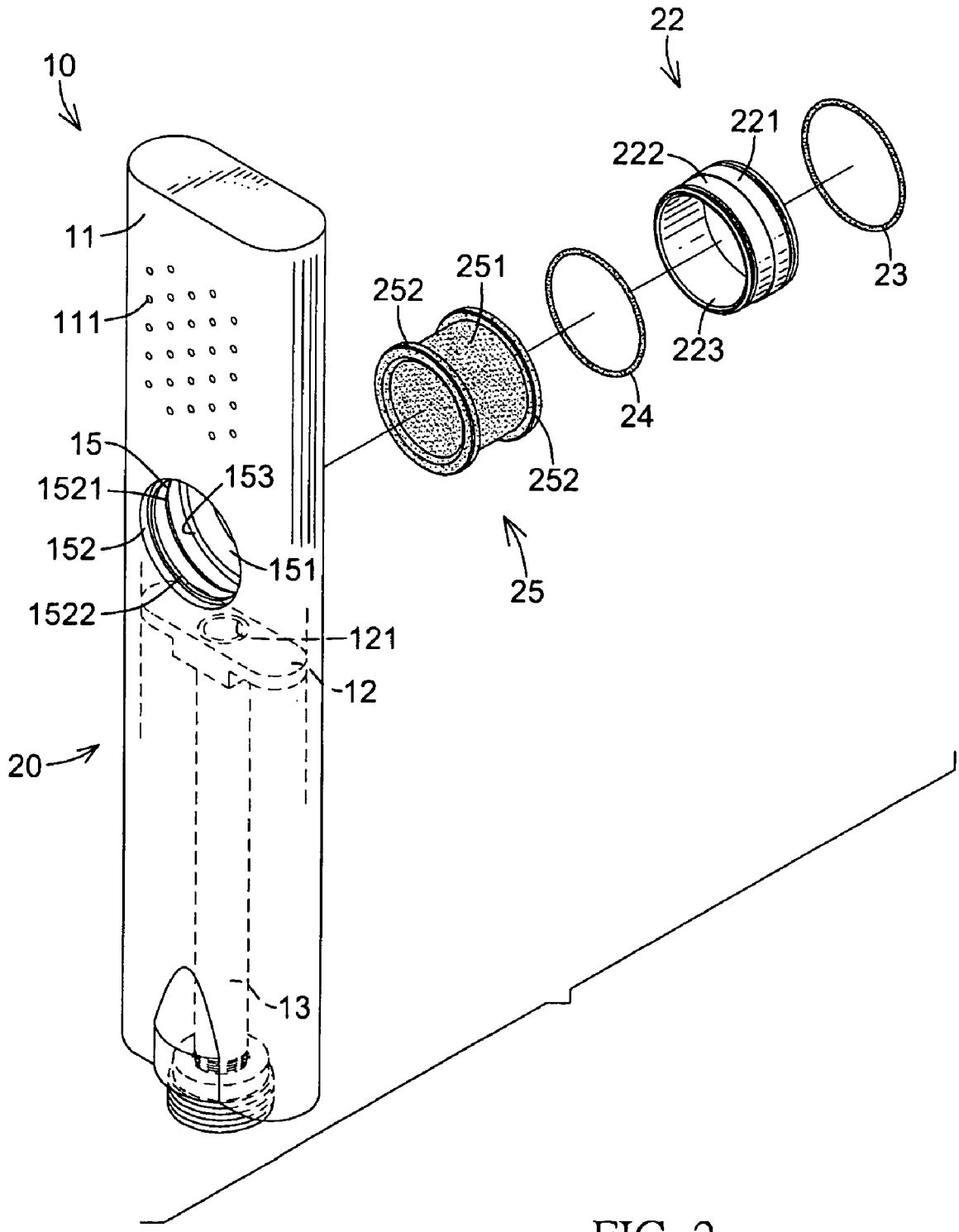
FIG. 2 is an exploded perspective view of the sanitary ware with the annular mount in FIG. 1.
Figure 3A:
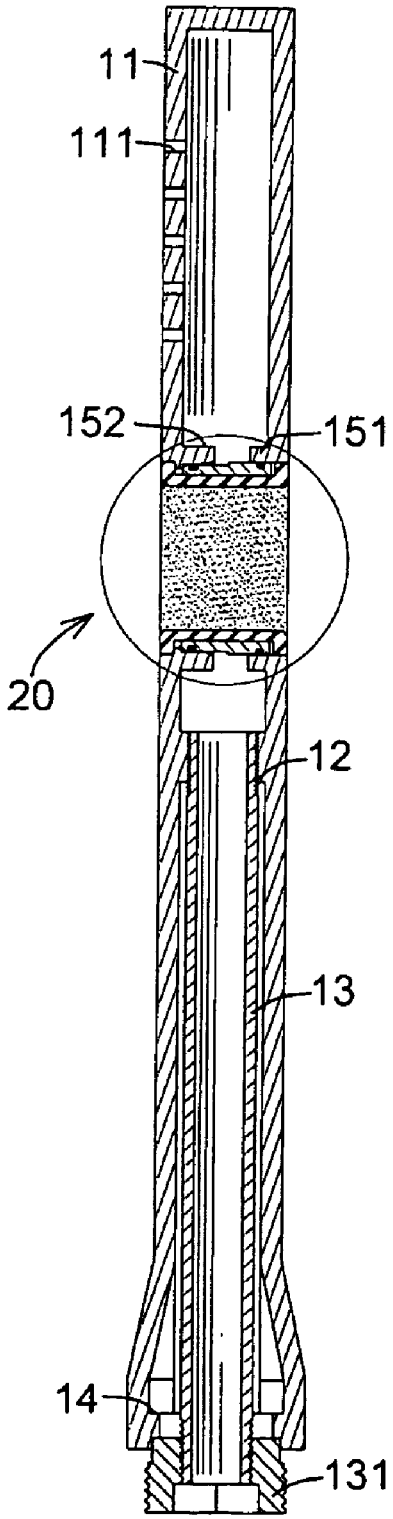
FIG. 3A is a side view in partial section of the sanitary ware with the annular mount in FIG. 1.
Figure 3B:
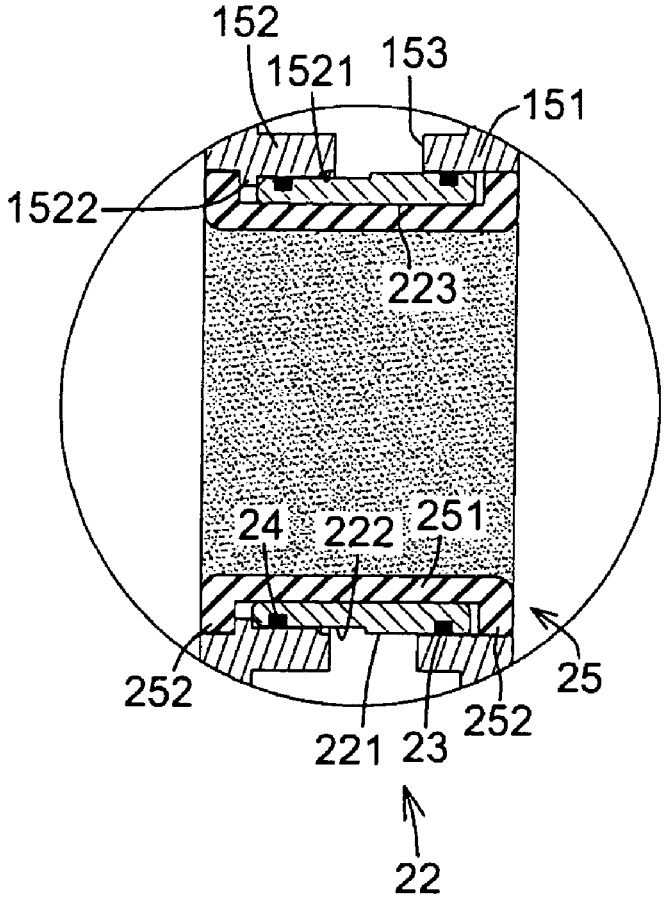
FIG. 3B is an enlarged side view in partial section of the sanitary ware with the annular mount in FIG. 1.

With reference to FIGS. 1 to 3, sanitary ware (10) with an annular mount in accordance with the present invention has a body (11), an inlet pipe (13) and an annular mount (20).

The body (11) may be any conventional sanitary device, such as shower head, pipe or faucet, and has a front, a rear a cavity, a top, a bottom, at least one output (111), a partition (12), a hose mount (14) and a through hole (15) and may be formed in the body (11). The cavity is defined inside the body (11).

In a preferred embodiment, the body (11) is rectangular and each output (111) is separately defined through the front of the body, maybe in the front.

The hose mount (14) is defined in the bottom of the body (11), communicates with the cavity and may be defined by the front and the rear and may be threaded. The through hole (15) is transversely defined through the body (11), is located below the output (111) and has a front edge, a rear edge, a rear shoulder (151), a front shoulder (152) and a gap (153). The front edge is disposed in the front of the body. The rear edge is located in the rear of the body. The rear shoulder (151) is annular, protrudes transversely from the rear edge of the through hole (15). The front shoulder (152) is annular, protrudes transversely from the front edge of the through hole (15) and has a free end, an inclined surface (1521) and a stop rib (1522). An inner diameter of the front shoulder (152) is smaller than an inner diameter of the rear shoulder (151). A ratio of diameters of the front to rear shoulders (151,152) may be between 1:1 to 1:1.03. The inclined surface (1521) is defined at the free end of the front shoulder (152). The stop rib (1522) is formed around the front shoulder (152) near the front edge. The gap (153) is formed between the rear shoulder (151) and the front shoulder (152) and communicates with the cavity in the body (11). The partition (12) is formed inside the cavity below the through hole (15) to prevent water flowing down the cavity and has a passing hole (121) defined in the partition (12) and the passing hole (121) communicates with the cavity in the body.

The inlet pipe (13) is mounted in the cavity in the body (11) and in the partition (12) and has a proximal end. The proximal end is mounted in the hose mount (14) and may engage the threads of the hose mount (14) and has a joint (131). The joint (131) is formed on the proximal end for connecting to a hose.

The annular mount (20) is mounted inside the through hole (15) in the body (11) and has a base ring (22), two O-rings (23, 24) and a sleeve (25). The base ring (22) is mounted in the through hole (15) and has an abutting end, a rear end, a front end (222), a rear end (221) and a through hole (223). The front end (222) is integrally formed with the rear end (221). The front end (222) is receiving inside the through hole (15) mounted adjacent to the front shoulder (152) and abuts the stop rib (1522) and has an outer diameter. The rear end (221) is receiving inside the through hole (15) mounted adjacent to the rear shoulder (151) and has an outer diameter. The outer diameter of the front end (222) is slightly larger than the outer diameter of the rear end (221). A ratio of the outer diameter of the front end to the outer diameter of the rear end of the base ring (22) is about 1:1 to 1:1.03. The through hole (223) is defined through the base ring (22). The O-rings (23, 24) are mounted around the base ring (22) respectively at the ends of the base ring (22).

The sleeve (25) may be made of rubber, is mounted through the base ring (22) and has a sleeve body (251) and two lips (252). The sleeve body (251) has two ends. The lips (252) are formed respectively around the ends of the sleeve body (251).

Because the inlet pipe (13) is mounted inside the body (11) and hot water does not touch the body (11) below the partition (12), the hot water scald a user holding the body.

Figure 4:
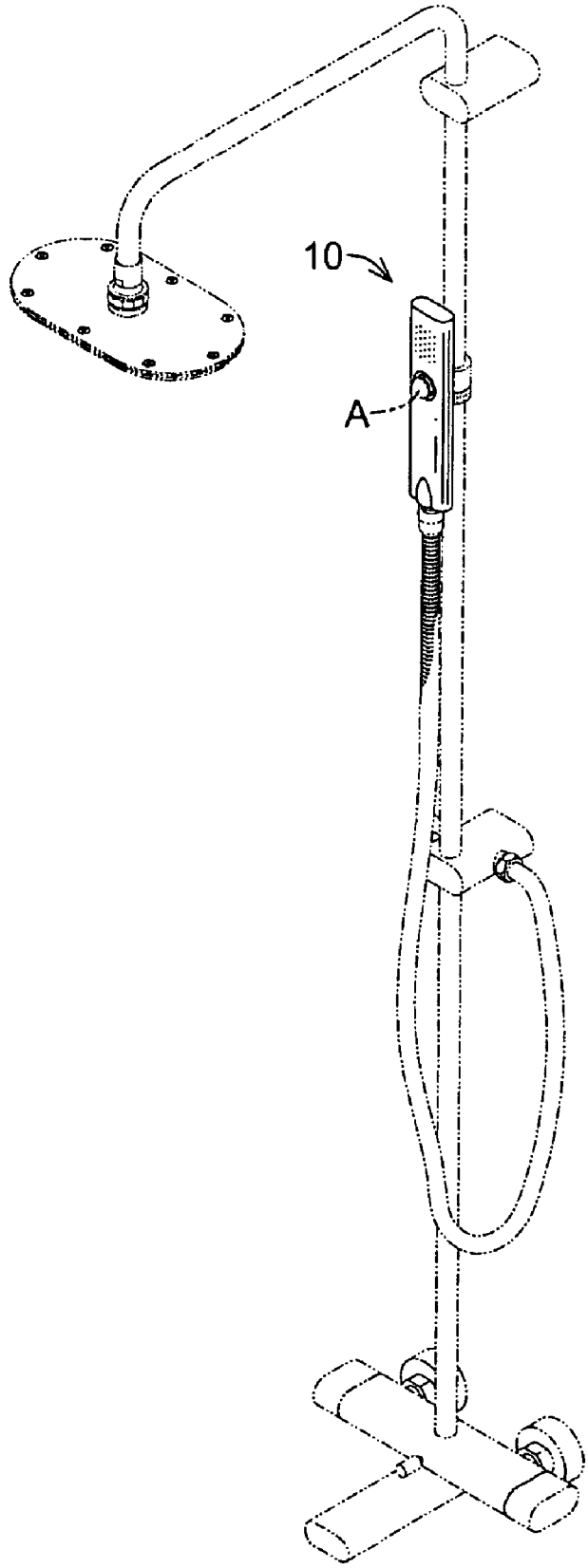
FIG. 4 is a perspective view of showing an operational embodiment of the sanitary ware with the annular mount in FIG. 1.

With reference to FIG. 4, the sanitary ware (10) with the annular mount may be hung on a hook (A) using the annular mount (20). The hook (A) is a circular hook mounted on a shower stand and has an enlarged free end. The annular mount (20) of the present invention is hung on the hook (A) by passing through the enlarged free end. Since the annular mount (20) is formed by the base ring (22) and the sleeve (25), water will not leak from the annular mount (20).

The advantages of the sanitary ware (10) are as follows.

1. The structure of the annular mount described in the present invention is simple and is easily fabricated.

2. The annular mount may be used in any kind sanitary ware for hang the sanitary ware.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. Sanitary ware with an annular mount comprising a body having a top;

a bottom;

a front;

a rear;

a hose mount being defined in the bottom of the body and communicating with a cavity; and a through hole transversely defined through the body and having a front edge being disposed in the front of the body;

a rear edge being disposed in the rear of the body;

a rear shoulder being annular, protruding transversely from the rear edge of the through hole, and having an inner diameter;

a front shoulder being annular, protruding transversely from the front edge of the through hole and has an inner diameter which is smaller than the inner diameter of the rear shoulder and having a free end;

an inclined surface being defined at the free end of the front shoulder; and a stop rib being formed around the front shoulder near the front edge; and a gap being formed between the rear shoulder and the front shoulder and communicating with the cavity in the body;

an inlet pipe being mounted in the cavity and having a proximal end being mounted in the hose mount and the proximal end having a joint; and an annular mount being mounted inside the through hole in the body and having a base ring being mounted in the through hole and having a front end being mounted adjacent to the front shoulder and abutting the stop rib;

a rear end being mounted adjacent to the rear shoulder; and a through hole being defined through the base ring;

two O-rings being mounted around the base ring respectively at the ends of the base ring; and a sleeve being mounted through the base ring and having a sleeve body having two ends; and two lips being formed respectively around the ends of the sleeve body.

2. The sanitary ware with the annular mount as claimed in claim 1, wherein;

a ratio of diameters of the front to rear shoulders is between 1:1 and 1:1.03; and a ratio of the front end of the base ring to the rear end of the base ring is about 1:1 to 1:1.03.

3. The sanitary ware with the annular mount as claimed in claim 2, wherein the body is a shower nozzle and further comprises at least one output being separately defined in the front of the body; and a partition being formed inside the cavity below the through hole and having a passing hole defined in the partition and communicating the cavity in the body.

4. The sanitary ware with the annular mount as claimed in claim 3, wherein the body is rectangular, and the through hole is transversely defined through the body and is located below the output.

5. The sanitary ware with annular mount as claimed in claim 4, wherein the sleeve is made of rubber.

* * * * *